US006238585B1

(12) United States Patent
Miyata

(10) Patent No.: US 6,238,585 B1
(45) Date of Patent: May 29, 2001

(54) METHOD FOR MANUFACTURING AN INK-JET HEAD HAVING NOZZLE OPENINGS WITH A CONSTANT WIDTH

(75) Inventor: Yoshinao Miyata, Nagano (JP)

(73) Assignee: Seiko Epson Corporation, Nagano (JP)

( * ) Notice: Subject to any disclaimer, the term of this patent is extended or adjusted under 35 U.S.C. 154(b) by 0 days.

(21) Appl. No.: 09/370,923

(22) Filed: Aug. 10, 1999

Related U.S. Application Data

(62) Division of application No. 08/675,053, filed on Jul. 3, 1996, now Pat. No. 5,992,974.

(30) Foreign Application Priority Data

Jul. 3, 1995 (JP) ..... 7-167725
Jun. 17, 1996 (JP) ..... 8-177136
Jul. 1, 1996 (JP) ..... 8-190102

(51) Int. Cl.[7] ..... B41J 2/16
(52) U.S. Cl. ..... 216/27; 216/99
(58) Field of Search ..... 216/2, 27, 99

(56) References Cited

U.S. PATENT DOCUMENTS 3,921,916 * 11/1975 Bassous ..... 239/601
3,949,410 * 4/1976 Bassous et al. ..... 346/75
4,047,184 * 9/1977 Bassous et al. ..... 216/27
4,312,008 * 1/1982 Taub et al. ..... 346/140 R
4,600,934 * 7/1986 Aine et al. ..... 357/26
4,733,823 * 3/1988 Waggener et al. ..... 239/601
4,863,560 9/1989 Hawkins ..... 156/644

(List continued on next page.)

FOREIGN PATENT DOCUMENTS

4214555 A1 * 11/1993 (DE) .
600382 A2 * 6/1994 (EP) .
652108 A2 * 5/1995 (EP) .
6-55733 * 3/1994 (JP) .
6-206315 * 7/1994 (JP) .
7-125210 * 5/1995 (JP) .

OTHER PUBLICATIONS

IBM Technical Disclosure Bulletin, vol. 35, No. 2, Jul. 1992, pp. 402–403.
IBM Technical Disclosure Bulletin, vol. 27, No. 3, Aug. 1984, pp. 1532–1533.
IBM Technical Disclosure Bulletin, vol. 20, No. 6, Nov. 1977, pp. 2474–2479.
Kuhn, L. et al "Silicon Chrage Electrode Array for Ink Jet PRinting" IEEE Trans. Electron devices, vol.ED–25, No. 10, pp 1257–60, Oct. 1978.*
Nepela, D.A. et al "Method for manufacturing silicon ink jet nozzles" IBM Tech. Discl. Bull. 22(9) 4171, Feb. 1980.*
Bassous, E. "Nozzle arrays in mesa structures ethced in single crystal silicon" IBM Tech. Discl. Bull. 19(6) 2249–50, Nov. 1976.*

(List continued on next page.)

*Primary Examiner*—Anita Alanko
(74) *Attorney, Agent, or Firm*—Sughrue, Mion, Zinn, Macpeak & Seas, PLLC

(57) ABSTRACT

A nozzle plate has a plurality of nozzles for discharging ink which is fed from an ink reservoir to ink cavities through ink supply ports and is pressurized by a pressurizing element. In the nozzle plate, nozzle openings are formed in a silicon monocrystalline substrate with a lattice face (110) by anisotropic etching in such a way that through holes have faces (1-11) and (-11-1) in the direction in which the nozzle opening are arrayed as well as faces (111) and (11-1) in the direction of the axis of the ink cavity. The nozzle openings can be formed so as to have the faces (1-11) and (-11-1) normal to the silicon monocrystalline substrate in the direction in which the nozzle openings are arrayed. The width of the nozzle opening becomes constant irrespective of the time required to etch the substrate.

16 Claims, 8 Drawing Sheets

U.S. PATENT DOCUMENTS

| | | | | |
|---|---|---|---|---|
| 5,096,535 | | 3/1992 | Hawkins et al. | 156/633 |
| 5,131,978 | * | 7/1992 | O'Neill | 156/653 |
| 5,204,690 | * | 4/1993 | Lorenze, Jr. et al. | 346/1.1 |
| 5,277,755 | * | 1/1994 | O'Neill | 156/647 |
| 5,385,635 | * | 1/1995 | O'Neill | 156/647 |
| 5,502,471 | * | 3/1996 | Obermeier et al. | 347/65 |
| 5,608,436 | * | 3/1997 | Baughman et al. | 347/65 |
| 5,635,968 | | 6/1997 | Bhaskar et al. | 347/59 |
| 5,870,123 | * | 2/1999 | Lorenze, Jr. et al. | 216/27 |
| 5,883,012 | * | 3/1999 | Chiou et al. | 216/99 |
| 5,922,218 | * | 7/1999 | Miyata et al. | 216/27 |
| 5,971,527 | * | 10/1999 | Peeters et al. | 216/99 |

OTHER PUBLICATIONS

Smith, L. et al "Continuous innk–jet print head utilizing silicon micromachined nozzles" Sensors and Actuators A 43, pp311–316, 1994.*

"Supersonic reactive gas jet chemical processing" IBM Tech. Discl. Bull. 35(2) 402–403, Jul. 1992.*

Bassous, E. "Fabrication Process for precise control of nozzle dimensions" IBM Tech.Disc. Bull. 20(6) 2474–79, Nov. 1977.*

Bassous, E. "Fabrication of novel three–dimensional microstructures by the anisotropic etching of (100) and (110) silicon" IEEE Trans. Electron Devices, vol.ED–25, No. 10, 1178–85, Oct. 1978.*

Petersen, K.E. "Fabrication of an integrated, planar silicon ink–jet structure" IEEE Trans. Electron Devices, vol.ED–26, No. 12, 1918–20, Dec. 1979.*

* cited by examiner

FIG. 5(a')
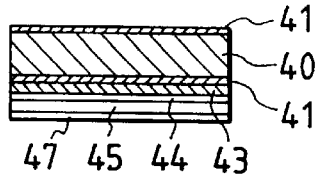
FIG. 5(b')
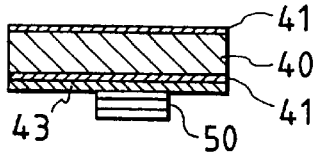
FIG. 5(c')
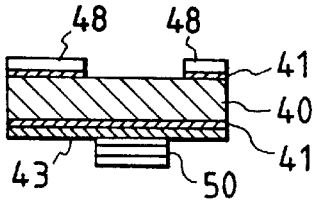
FIG. 5(d')
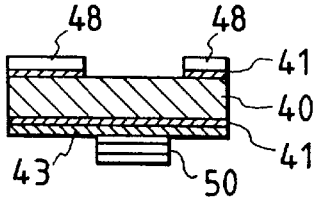
FIG. 5(e')
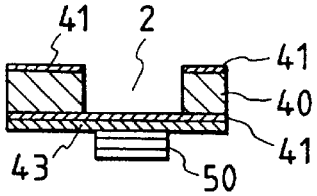
FIG. 5(f')
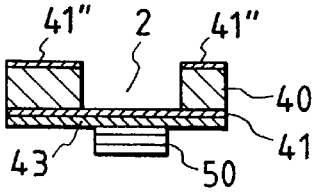
FIG. 5(g')
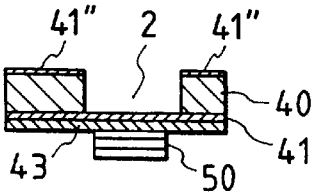
FIG. 5(h')
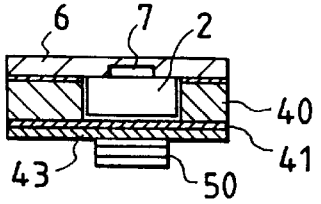

METHOD FOR MANUFACTURING AN INK-JET HEAD HAVING NOZZLE OPENINGS WITH A CONSTANT WIDTH

This is a divisional of application Ser. No. 08/675,053, filed Jul. 3, 1996, now U.S. Pat. No. 5,992,974, the disclosure which is incorporated herein by reference.

BACKGROUND OF THE INVENTION

1. Field of the Invention

The present invention relates to an ink-jet head having nozzle openings through which ink droplets are discharged and manufacturing method thereof.

2. Description of the Prior Art

Improvements in recording density result in an increasingly dense array of nozzle openings. For this reason, there has been a demand for nozzle openings arrayed with high accuracy as well as for nozzle openings having high dimensional accuracy. Means for solving such a problem are disclosed in, for example, Japanese Patent Publication No. Hei. 6-55733. It proposes that ink cavities, an ink reservoir for feeding ink to the ink cavities, and an ink supply port for connecting the ink cavities to the ink reservoir be formed in a silicon monocrystalline substrate by anisotropic etching, and that a nozzle plate, in which nozzle openings are formed by anisotropically etching a silicon monocrystalline substrate having a face (100), and the silicon monocrystalline substrate be bonded into an integrally formed ink-jet recording head.

The article entitled "Continuous Ink-jet Print Head Utilizing Silicon Micromachined Nozzles" in "Sensors and Actuators A", 43 (1994), pp. 311–316, discloses a method of manufacturing a nozzle plate for use with an ink-jet printer. According to this method, boron is diffused into designated areas of a silicon monocrystalline substrate having a (100) face where nozzle openings are to be formed. The areas into which boron was diffused are selectively etched, whereby a plurality of nozzle openings are formed.

As previously described, the technique disclosed in Japanese Patent Publication No. Hei. 6-55733 uses the silicon monocrystalline substrate having a (100) face. If the silicon monocrystalline substrate is anisotropically etched, nozzle openings J, each consisting of four planes E, F, G, and H at an angle of 45° with respect to the face (100), are recessed in the silicon monocrystalline substrate which constitutes a nozzle plate D, as shown in FIG. 9 (here reference symbol N designates a spacer which forms ink cavities K, ink supply ports L, and an ink reservoir M, and P designates a vibrating plate having pressure generating means Q formed therein).

If through-holes are formed in the face (100) of the silicon monocrystalline substrate by anisotropic etching, a ratio of a side length of the maximum opening of the through-hole to the thickness of the substrate becomes 2:1, as is well known. For this reason, it is necessary to limit the thickness of the silicon monocrystalline substrate to about 70 μm in order to form nozzle openings at a density of 180 DPI or thereabouts.

To form ink dots having a size suitable for a printing operation, it is necessary for the minimum opening of the discharge orifice to have a diameter of 30 μm. Allowing for the accuracy of formation of patterns used for arraying the nozzle openings, it is also necessary to ensure a pitch of about 10 m between the patterns. Because of these requirements, a silicon monocrystalline substrate which is considerably as thin as 30 μm or thereabouts becomes necessary.

Even in the case of a silicon monocrystalline substrate having a diameter of about 100 mm (a 4-inch wafer), it is very difficult to cut that substrate to a thickness of about 30 μm. Further, the rigidity of a sliced silicon monocrystalline substrate becomes extremely low, and hence it becomes very difficult to bond the substrate to another element, which in turn complicates manufacturing steps.

According to the technique disclosed in the article entitled "Sensors and Actuators A", the boron-diffused areas are etched. The depth to which boron can be diffused is, at most, 2–3 μm or thereabouts, which makes a handling operation for bonding the substrate to another element considerably difficult. Hence, this technique is impossible to use from an industrial point of view.

SUMMARY OF THE INVENTION

The present invention has been conceived in view of the foregoing drawbacks in the art, and the primary object of the invention is to provide an ink-jet head having a nozzle plate made of a silicon monocrystalline substrate into which nozzle openings can be arrayed at a high density while the ease of handling required to assemble the nozzle plate is ensured.

Another object of the present invention is to provide a method of manufacturing the above described ink-jet head.

According to the present invention, there is provided an ink-jet head comprising: a spacer having a plurality of ink reservoirs, ink supply ports and ink cavities which receive ink fed from the ink reservoir thereto through the ink supply ports; a cover member for sealing one side of the spacer; a nozzle plate sealing the other side of the spacer and made of a silicon monocrystalline substrate with a lattice face (110), wherein a plurality of nozzle openings are formed so as to be communicated with the ink cavities and include faces (1-11) and (-11-1) in the direction in which the nozzle openings are arrayed as well as faces (111) and (11-1) in the direction of the axis of each ink cavity, and the nozzle openings have maximum diameter portions which are open to the ink cavities and minimum diameter portions which are positioned opposite to the maximum diameter portions; and means for pressurizing the ink cavity.

The nozzle openings have the faces (1-11) and (-11-1) perpendicular to the substrate in the direction in which the nozzle openings are arrayed. Accordingly, the width of the discharge orifice becomes constant irrespective of the time required to etch the substrate which constitutes the nozzle plate. As a result, the nozzle openings are formed to a width defined by patterning.

DETAILED DESCRIPTION OF THE PREFERRED EMBODIMENTS.

The details of the present invention will be described hereinbelow with reference to an illustrative embodiment.

Throughout the following descriptions of the embodiment, a lattice face will be herein described as (110), a lattice orientation as <110>, and a unit cell of 1 bar as -1.

Figure 1A:
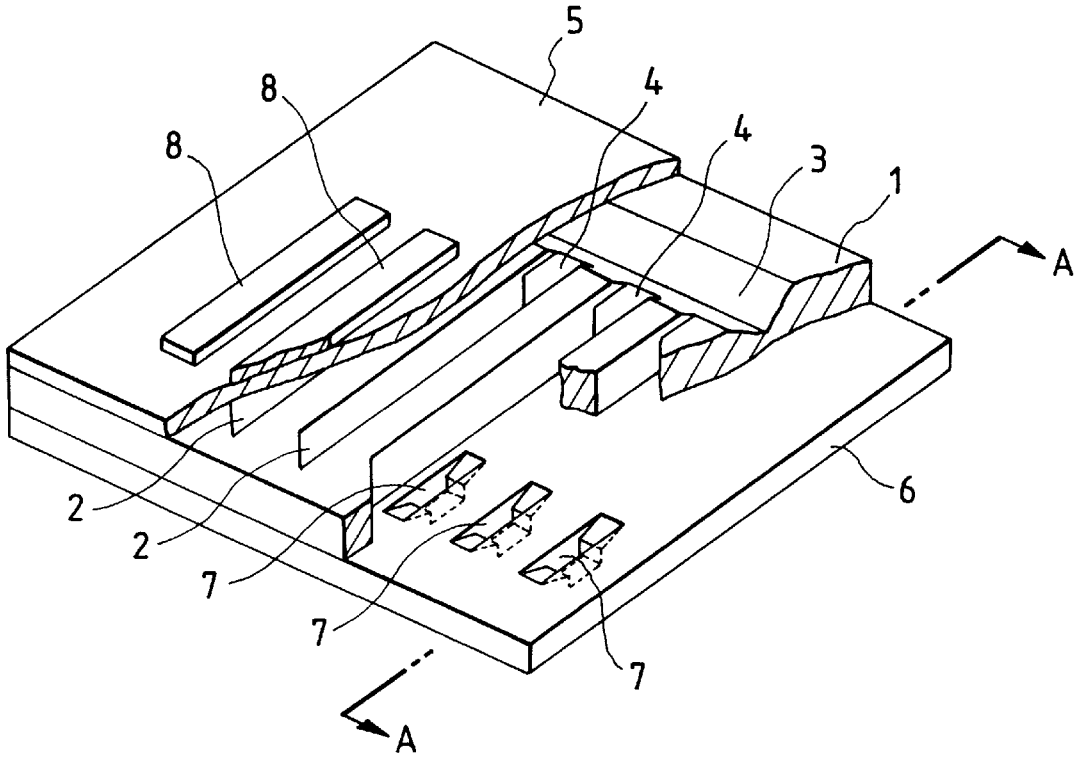
FIGS. 1(*a*) and 1(*b*) show an ink-jet recording head which uses a nozzle plate according to a first embodiment of the present invention, wherein FIG. 1(*a*) is a plan view of the ink-jet recording head and FIG. 1(*b*) is a cross-sectional view taken along line A—A shown in FIG. 1(*a*)
Figure 1B:
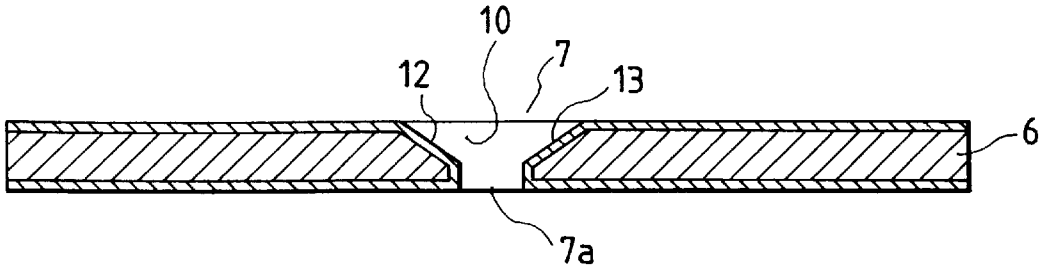

FIGS. 1(*a*) and 1(*b*) show a first embodiment of the an ink-jet recording head according to the present invention. In the drawings, reference numeral 1 designates a spacer. In the present embodiment, the spacer 1 is formed by anisotropically etching a silicon monocrystalline substrate with a lattice face (110) so as to constitute ink cavities 2, an ink reservoir 3, and ink supply ports 4.

One side of the spacer 1 is sealed with a cover member 5 which will be described later, whereas the other side is sealed with a nozzle plate 6 which is a feature of the present invention. Ink droplets are discharged from nozzle openings 7 as a result of the generation of pressure in the ink cavities 2.

As in the present embodiment, piezoelectric elements 8 can be used as the pressure generating elements. They are disposed on, while remaining in contact with, the top of the cover member 5 is as to be opposite to the respective in k cavities 2. In the case where an inelastically deformable material is used for the pressure generating element, Joule's heat generating elements can be housed in the ink cavities 2.

In the drawing, the nozzle plate 6 which is a feature of the present invention comprises the nozzle openings 7 arrayed at constant pitches which are formed by anisotropically etching the silicon monocrystalline substrate with the face (110) which will be described later. In the case where the nozzle openings 7 are formed by anisotropically etching the silicon monocrystalline substrate with the face (110), the nozzle openings are formed in the shape of recesses consisting of a face 10, a face 11, a face 12, and a face 13 thereby forming maximum diameter portions which are open to the ink cavities 2 and minimum diameter portions which are positioned opposite to the maximum diameter portions. Further, a cylindrical portion 7*a* suitable for discharging ink droplets is formed on the discharge side of the discharge orifice by using isotropic etching in combination with anisotropic etching.

Figure 2:
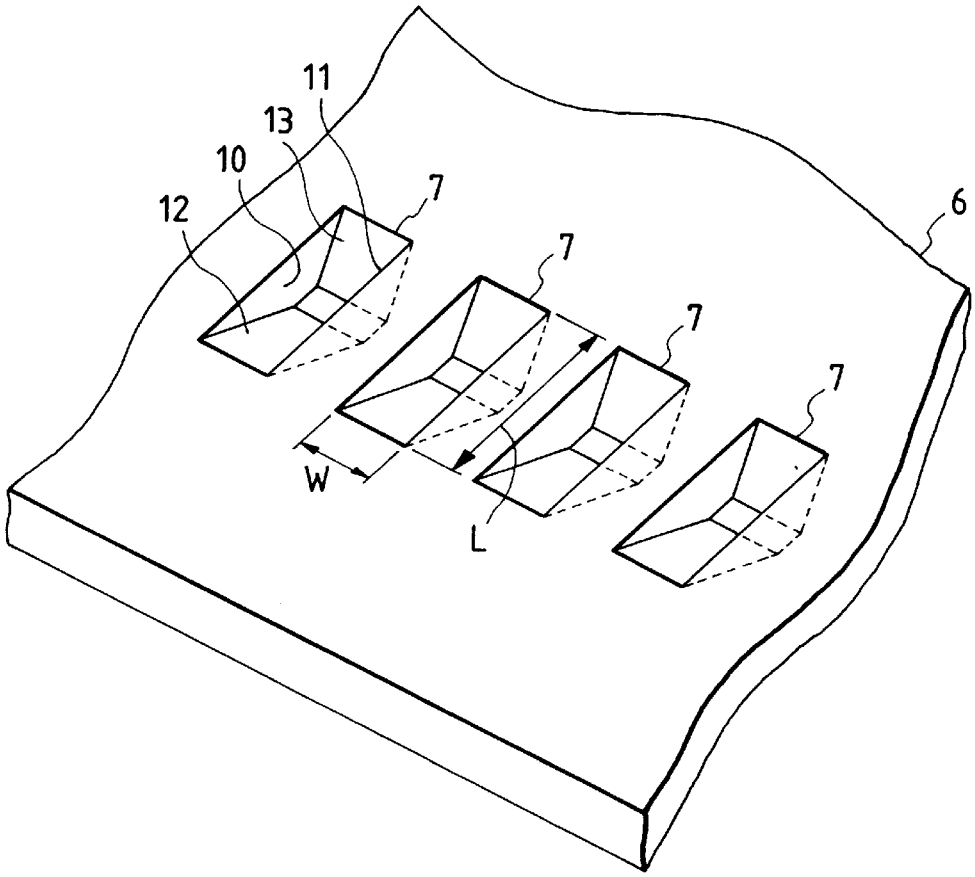
FIG. 2 is an enlarge view of the vicinity of nozzle openings formed in the nozzle plate of the present invention.

FIG. 2 is an enlarged view showing the vicinity of the nozzle openings. Both the faces 10 and 11 intrinsically appear as a natural result of the anisotropic etching of the silicon monocrystalline substrate with the face (110). The face 10 is a face (1-11) normal to the (110) face of the silicon monocrystalline substrate, whereas the face 11 is a face (1-11) parallel to a face (-11-1) which is equivalent to the face 10, namely, the face 11 is normal to the (110) face of the silicon monocrystalline substrate.

The face 12 is a (111) plane which appears at an angle of about 35° with respect to the (110) face of the silicon monocrystalline substrate. Similarly, the face 13 is a face (11-1) which appears at an angle of 35° with respect to the (110) face of the silicon monocrystalline substrate. The faces (1-11), (-11-1), (1-1-1), and (-111) normal to the face (110) will be hereinafter simply referred to as a vertical (111) face. Moreover, faces (111) and (11-1), which come about at an angle of about 35° with respect to the face (110), will be hereinafter simply referred to as a face (111) at an angle of 35°.

Of the four side faces which form the recess, the two faces 10 and 11 which are opposite to each other are orthogonal to the surface of the silicon monocrystalline substrate. Therefore, there will be very little chance of the recess extending at least in a horizontal direction, that is, in the direction parallel to the surface of the silicon monocrystalline substrate irrespective of the progress of the etching operation. A pitch W between the faces 10 and 11 becomes constant irrespective of the thickness of the silicon monocrystalline substrate, namely, it becomes equal to the size defined by a protecting film used in the anisotropic etching operation.

For these reasons, a mask of the nozzle openings 7 is formed such that the nozzle openings are arrayed in the direction in which the faces 10 and 11 are opposite to each other, and then the substrate covered with the mask is anisotropically etched. As a result, the nozzle openings 7 can be formed in the silicon monocrystalline substrate having a thickness which is easy to handle, without decreasing the pitch of the nozzle openings 7.

The faces 12 and 13 adjoining the vertical faces 10 and 11 are held at an angle of about 35° with respect to the surface of the silicon monocrystalline substrate. The boundary of the etched side of the substrate, that is, the wider side of the recess, becomes further away from the center as the anisotropic etching progresses, thereby increasing a distance L. The length L is in the longitudinal direction of the cavity 2, and therefore an increase in the distance L does not substantially affect the pitch of the nozzle openings 7.

Needless to say, the nozzle openings 7 can be formed in the same manner by use of other silicon monocrystalline substrates having faces (-110), (1-10), and (-1-10) on their surfaces which show the same etching characteristics as the silicon monocrystalline substrate having the face (110) on its surface.

In the present embodiment, if the ink cavities 2 filled with ink are pressurized by deforming the pressure generating means, for example, the piezoelectric elements 8 disposed on the cover member 5 which constitutes part of the ink cavities 2, the pressure in the cavities 2 is increased, whereby the ink is discharged from the nozzle openings 7.

As a result of a drop in the pressure of the ink cavities 2, the ink in the ink reservoir 3 is fed to the ink cavities 2 through the ink supply ports 4, and the ink cavities 2 are filled with the ink in preparation for the next discharging operation.

One embodiment of a method of manufacturing the ink-jet head according to a present invention will be described with reference to FIGS. 3(*a*) to 3(J).

Silicon dioxide layers 21 and 22 are formed to a thickness of about 1 $\mu$m on the respective sides of a silicon monocrystalline substrate 20 having a thickness which makes the nozzle plate 6 easy to handle, for example, a thickness of 140 μm, by thermal oxidation (FIG. 3(*a*)). These silicon oxide layers 21 and 22 laid on the respective sides of the silicon monocrystalline substrate serve as an etching mask when the silicon monocrystalline substrate 20 is etched.

Patterns best suitable for use as a nozzle, e.g., circular patterns 24, are patterned on one surface of the silicon monocrystalline substrate 20 where the nozzle openings 7 are to be formed, namely, the surface of the silicon oxide surface 21, using a positive photoresist 23 (FIG. 3(*b*)). Patterns identical with the patterns 24 are also patterned directly on the surface of the silicon dioxide layer 21, whereby nozzle patterns 25 are formed (FIG. 3(*c*)). The patterns are patterned on the silicon dioxide layer 21 by etching the silicon dioxide layer 21 having a thickness of about 1 μm for about ten minutes, using a buffer hydrofluoric acid solution which consists of hydrofluoric acid and ammonium fluoride at a rate of 1:6.

The dioxide layer 21 on which the patterns 25 are formed is exposed to a CF4 gas, and the silicon monocrystalline substrate 20 is isotropically etched by dry etching. Semicircular recesses 26 are formed in the silicon monocrystalline substrate 20 as a result of the extension of the etched surface (FIG. 3(*d*)).

The etching operation is suspended after the recesses have been etched to a predetermined size as a result of the progress of the isotropic etching operation. The isotropically etched surface is then subjected to thermal oxidation, or the like, so that the silicon dioxide layer 27 is formed on the recesses 26 (FIG. 3(*e*)).

A positive photoresist 28 is positioned on the surface of the silicon dioxide layer 22 in which tapered portions are to be formed, in such a way that the nozzle openings are arrayed in the direction of the faces (1-11) and (-11-1). Thereafter, windows 29 are patterned into a rectangular shape which will result in the shape most suitable for creating the tapered portion after an anisotropic etching operation has finished. In other words, the window 29 is laterally patterned to the width W of the discharge orifice 7 so as to ensure the same pitch as that on which the nozzle openings are arrayed, as well as being longitudinally patterned to the length L which permits the window to reach the aperture formed as a result of isotropic etching (FIG. 3(*f*)).

In this state, the silicon dioxide layer 22 is patterned using the buffer hydrofluoric acid solution which consists of hydrofluoric acid and ammonium fluoride at a rate of 1:6 in the same manner as previously described. As a result, windows 30 used for anisotropic etching are formed (FIG. 3(*g*)).

After the patterning for anisotropic etching purposes has been completed, the silicon monocrystalline substrate 20 is anisotropically etched in a 10% potassium hydroxide solution heated to a temperature of about 80° C. As a result of the anisotropic etching operation, the faces (1-11) and (-11-1) which are normal to the face (110) of the surface of the silicon monocrystalline substrate 20 appear in the direction in which the nozzle openings are arrayed. Further, the face (111) inclined at an angle of 35° with respect to the surface of the silicon monocrystalline substrate 20 appears in the longitudinal direction of the ink cavities 2. The etching operation is suspended when the silicon monocrystalline substrate 20 is etched away to the recess 26 of the silicon dioxide layer 27 (FIG. 3(*h*)).

Next, all the silicon dioxide layers 21, 22, and 27 are removed (FIG. 3(*i*)), so that a substantially circular opening 31*a* suitable for discharging ink droplets is formed in the cylindrical portion 7*a*. Finally, the overall exposed surface including the nozzle openings 7 is subjected to thermal oxidation, whereby a silicon dioxide layer 32 is formed so as to protect the exposed surface from the ink (FIG. 3(*j*)).

The silicon monocrystalline substrate 20 that has finished undergoing all of the etching processes is sliced into the individual nozzle plates 6. Eventually, nozzle plates suitable for use as a recording head can be obtained.

Figure 4:
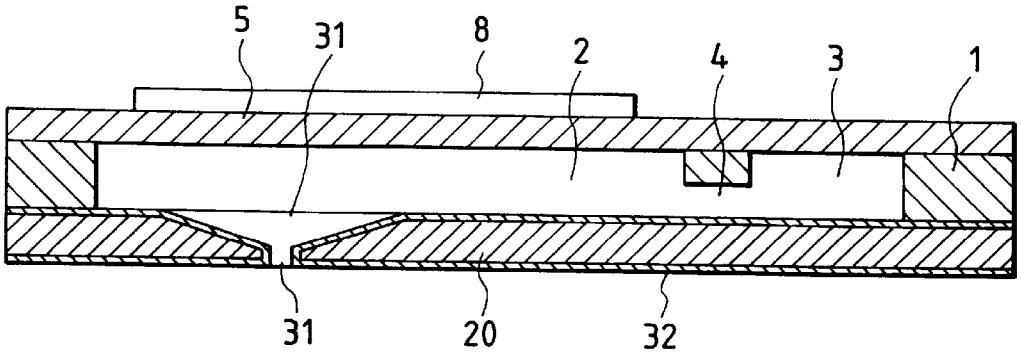
FIG. 4 is a cross-sectional view of the ink-jet recording head which uses the nozzle plate manufactured through the steps shown in FIGS. 3(*a*) to 3(*j*), according to the first embodiment of the present invention.
Figure 3A:
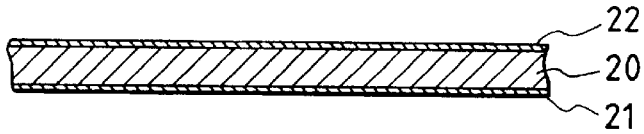
FIGS. 3(*a*) to 3(*j*) show steps of manufacturing the nozzle plate of the ink-jet head according to the present invention.
Figure 3B:
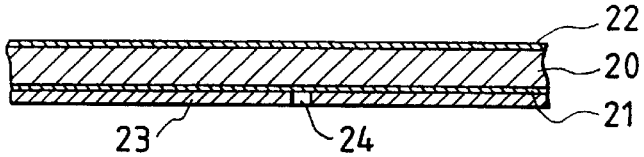
Figure 3C:
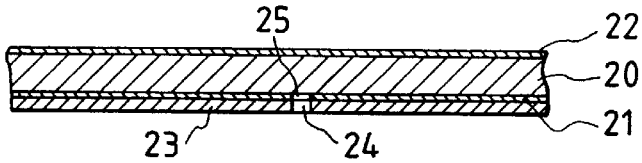
Figure 3D:
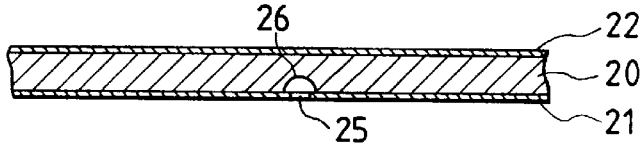
Figure 3E:
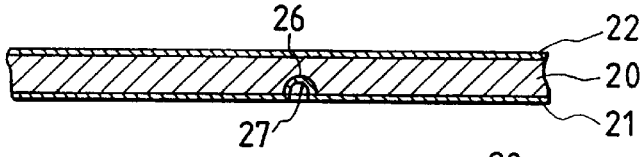
Figure 3F:
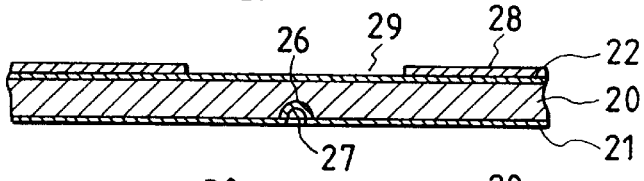
Figure 3G:
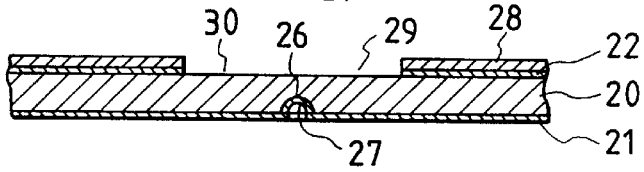
Figure 3H:
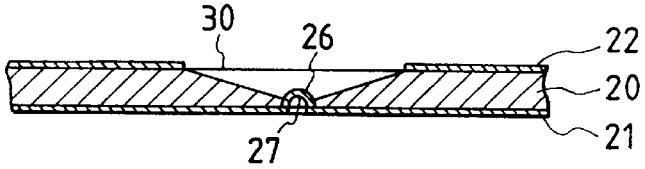
Figure 3I:
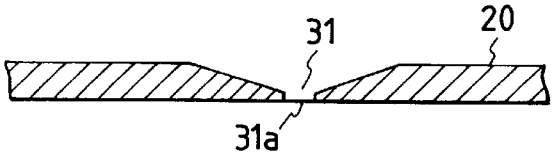
Figure 3J:
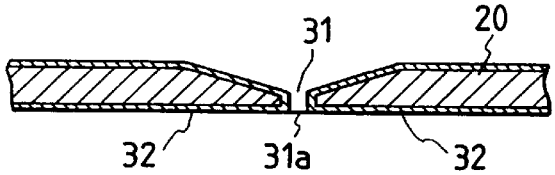
Figure 5A:
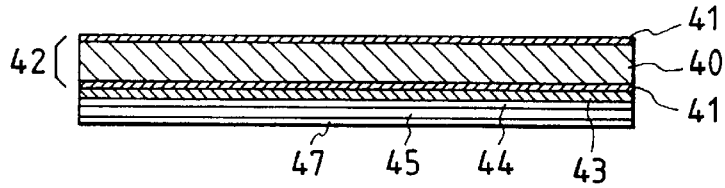
FIGS. 5(*a*) to 5(*h*) and 5(*a'*) to 5(*h'*) showing a method of assembling a spacer, a cover member, and pressure generating means into one unit.
Figure 5B:
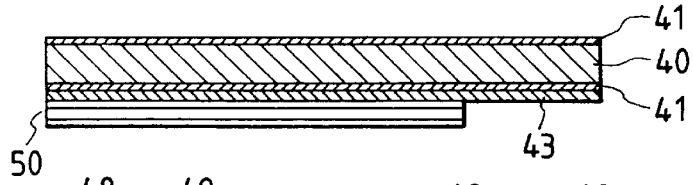
Figure 5C:
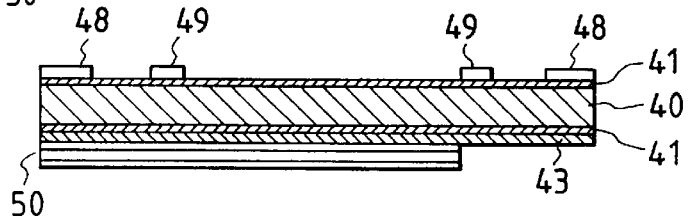
Figure 5D:
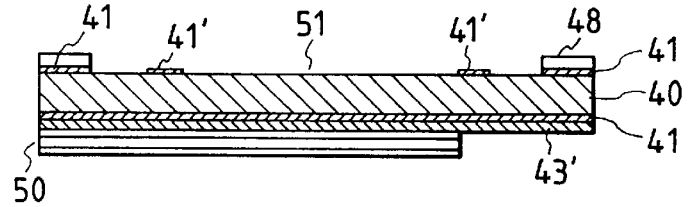
Figure 5E:
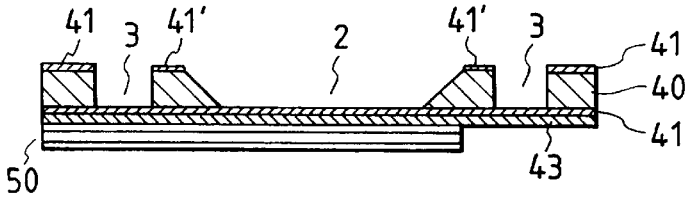
Figure 5F:
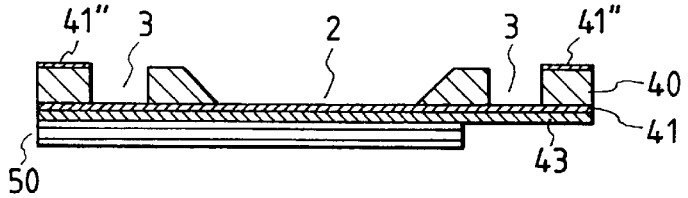
Figure 5G:
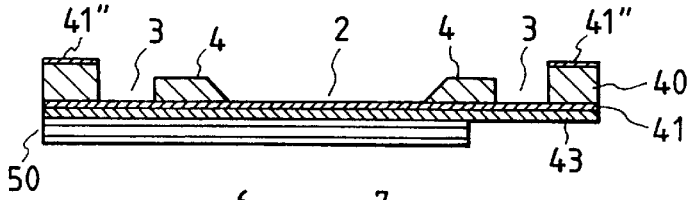
Figure 5H:
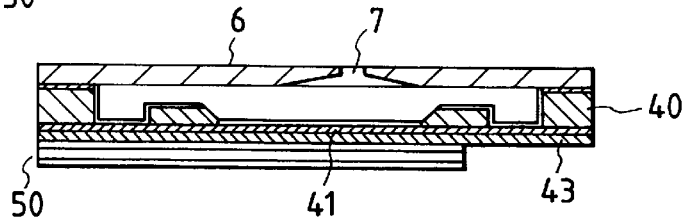

The spacer 1 comprising the ink cavities 2, the ink supply ports 4, and the ink reservoir 3 is bonded to the thus obtained nozzle plate 6, as shown in FIG. 4. The cover member 5 is further bonded to the top of the spacer 1, whereby the ink-jet recording head is completed. Hereupon, as described later, the spacer 1 is formed such that the ink cavities 2 are arrayed in the crystal orientation of the zone axis <1-1-2> defined by zone faces (1-1 1) and (1 1 0) or in the crystal orientations <-1 1 2>, <1-1 2> and <-1 1-2> equivalent to <1-1-2>. A layer of borosilicate glass is formed on the surface of the nozzle plate 6 which is opposite to the spacer 1 by sputtering, etc. The nozzle plate 6 and the spacer 1 are bonded together by the positive-pole bonding method. This makes it possible to prevent the flow of an adhesive into channels.

With reference to FIGS. 5(*a*) to 5(*h*) and 5(*a'*) to 5(*h'*), the manufacture of the previously described spacer, cover member, and the pressure generating means will be described. FIGS. 5(*a*) to 5(*h*) are longitudinal cross-sectional views of the ink cavities, whereas FIGS. 5(*a'*) to 5(*h'*) are lateral cross-sectional views of the same.

A silicon monocrystalline substrate 40 having its surface cut along the face (110) is subjected to thermal oxidation, whereby a base material 42 which is entirely covered with a silicon dioxide layer 41 having a thickness of about 1 m is prepared. The silicon dioxide layer 41 acts as an insulation film of a drive section which is to be formed on top of the silicon dioxide layer, as well as serving as a protecting layer when the silicon monocrystalline substrate 40 is etched.

A film of zirconia (Zr) is formed over the surface of the silicon dioxide layer 41 by sputtering. The film is then subjected to thermal oxidation, so that an elastic film 43 is formed from zirconium oxide to a thickness of 0.8 μm. The elastic film 43 formed from zirconium oxide has a high Young's modulus and, hence, is capable of converting strains of a piezoelectric film 45, which will be described later, into flexural displacements with a high degree of efficiency. A film of platinum (Pt) is formed over the surface of the elastic film 43 to a thickness of about 0.2 μm by sputtering, whereby a lower electrode 44 is formed.

A piezoelectric material such as PZT is deposited on the surface of the lower electrode 44 by sputtering, so that the piezoelectric film 45 having a thickness of about 1 μm is formed. Aluminum (Al) is further deposited on the surface of the piezoelectric film 45 to a thickness of 0.2 μm by sputtering, so that an upper electrode 47 is formed (FIGS. 5(*a*) to 5(*h*)).

The upper electrode 47, the piezoelectric film 45, and the lower electrode 44 are patterned so as to correspond to the array of the ink cavities 2. The patterned substrate is then sliced into the individual piezoelectric elements 8.

During the course of the patterning operation, each of the upper electrodes 47 is independently lead out so as to correspond to the ink cavity 2 such that the lead out electrode doubles as a lead wire to be connected to a drive circuit. Further, it is not necessary to separate the piezoelectric film 45 into independent subdivisions so as to correspond to the respective ink cavities 2 during the course of the patterning operation. However, if the piezoelectric film 45 were separated into the individual subdivisions so as to correspond to the respective ink cavities 2, larger flexural displacements would be advantageously ensured. The lower electrode 44 acts as a common electrode, that is, drive signal for driving the each piezoelectric film 45 is input to the each upper electrode 47 and the voltage of the lower electrode 44 is maintained at the predetermined value. Therefore, the lower electrode 44 should not be separated (FIGS. 5(*b*) and 5(*b'*)).

Photoresists 48 and 49 are formed such that the ink cavities 2 are arrayed in the crystal orientation of the zone axis <1-1-2> defined by zone faces (1-1 1) and (1 1 0) or in the crystal orientations <-1 1 2>, <1-1 2> and <-1 1-2> equivalent to <1-1-2> (FIGS. 5(*c*) and 5(*c'*)). The silicon dioxide layer is removed by use of the buffer hydrofluoric acid solution consisting of hydrofluoric acid and ammonium fluoride at a rate of 1:6, and then windows 51 for anisotropic etching purposes are patterned.

The portion corresponding to 49 of the photoresist 48, 49 on the silicon dioxide layer 41 on the silicon dioxide layer at the positions where the ink supply ports 4 are to be formed is again exposed and developed. That is, the photoresist 49 is subjected to multiple exposure, and the base material is further subjected to a half etching operation for about five minutes in order to reduce the thickness of the silicon dioxide layer positioned below the photoresist layer 49 to a thickness of about 0.5 $\mu$m (numeral 41') using the previously described buffer hydrofluoric acid solution (FIGS. 5(*d*) and 5(*d'*)).

After the removal of the photoresist layer 48, the base material 42 is anisotropically etched in the 10% potassium hydroxide solution heated to a temperature of about 80° C. As a result of the anisotropic etching operation, the silicon dioxide layers 41 and 41' which served as the protecting film during the anisotropic etching operation are gradually dissolved by a thickness of about 0.4 $\mu$m. As a consequence, the silicon dioxide layer 41' at the areas where the ink supply ports 4 are to be formed is reduced to a thickness of about 0.1 $\mu$m, and the silicon dioxide layer 41 in the other areas is reduced to a thickness of about 0.6 $\mu$m (FIGS. 5(*e*) and 5(*e'*)).

The base material 42 is then immersed into the previously described buffer hydrofluoric acid solution for a period of time which makes it possible to eliminate the silicon dioxide layer having a thickness of 0.1 $\mu$m, for example, about one minute. As a result, the silicon dioxide layer 41' at the areas where the ink supply ports 4 are to be formed is removed, and the silicon dioxide film 41 in the other areas is left as a layer 41" having a thickness of about 0.5 $\mu$m (FIGS. 5(*f*) and 5 (*f'*)).

The base material 42 is then anisotropically etched in an about 40% potassium hydroxide solution. Consequently, the areas where the ink supply ports 4 are to be formed are etched again. The thickness of those areas is reduced, and recesses having sufficient flow resistance for the ink supply ports 4 are formed (FIGS. 5(*g*) and 5(*g'*)).

If a plurality of recording heads are formed in one base material 42, the base material is separated into individual recording heads. Then the aforementioned nozzle plate 6 is bonded and an-ink jet head is constructed (FIGS. 5(*h*) and 5(*h'*)).

In the ink-jet recording head having the above construction, if a drive signal is applied between the upper electrode 47 and the lower electrode 44, the piezoelectric film 45 expands and contracts so as to cause displacements, which in turn produce stresses with respect to the cover member 5. Specifically, the displacements develop in the upward direction of the drawing. As a result of the displacements, the volume of the ink cavities 2 is changed, which in turn pressurizes the ink. The ink returns to the ink reservoir 3 through the ink supply ports 4, and it is then discharged as ink droplets.

According to this embodiment, necessary channels can be formed by anisotropically etching a single silicon monocrystalline substrate. Hence, the spacer 1 and the nozzle plate 6 can be manufactured as common parts, which eliminates the need for the operation for applying adhesive to bond the spacer to the nozzle plate. Simplified manufacturing processes and an extinction in the flow of an adhesive into the ink channels are eventually attained, which makes it possible to improve product yield.

Figure 6A:
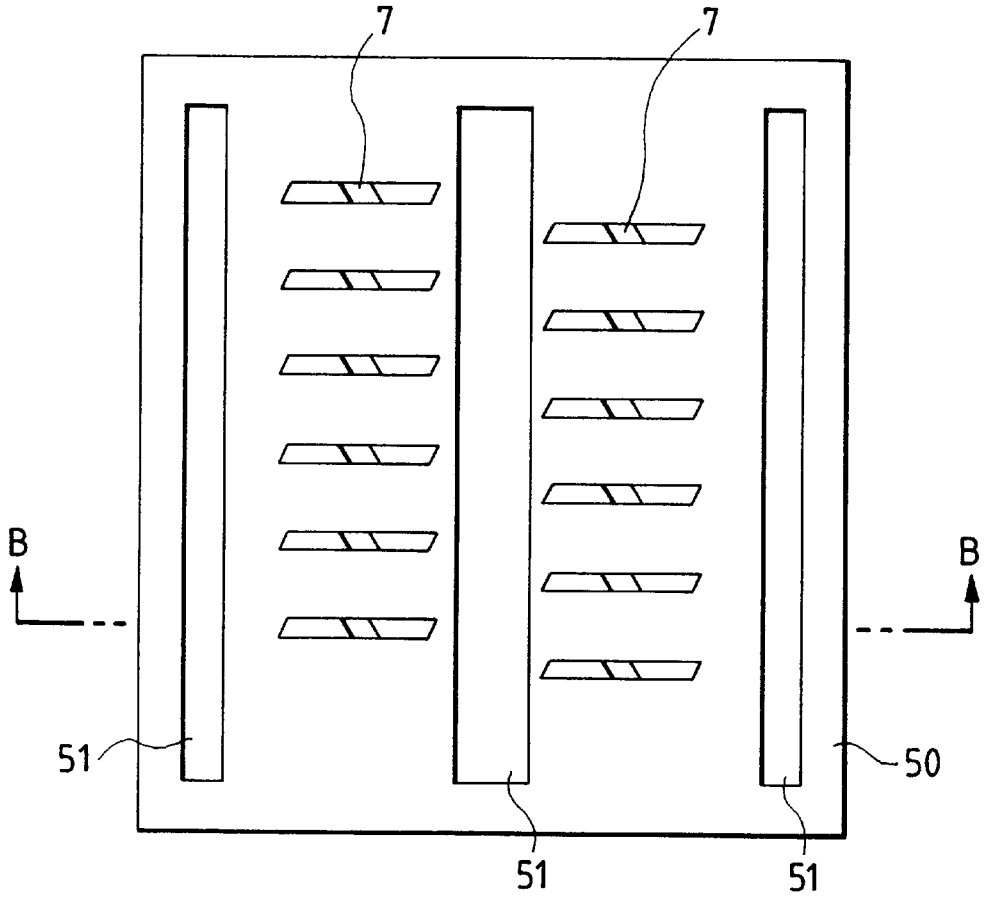
FIG. 6(*a*) is a plan view of a nozzle plate according to a second embodiment of the present invention, and FIG. 6(*b*) is a cross-sectional view taken along line B—B shown in FIG. 6(*a*)
Figure 6B:
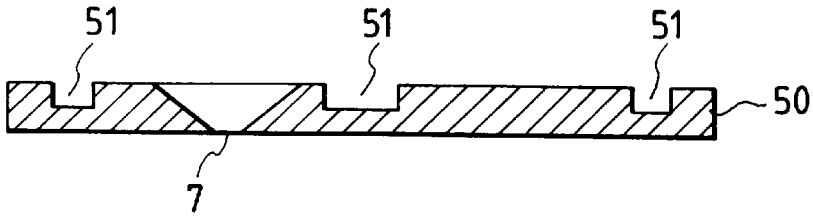

FIGS. 6(*a*) and 6(*b*) show a second embodiment of the nozzle plate according to the present invention. In the present embodiment, the ink reservoirs are formed in the previously described nozzle plate 6.

Reference numeral 50 in the drawing designates a silicon monocrystalline substrate having a face (110) on its surface, and the nozzle openings 7 are formed in the silicon monocrystalline substrate so as to be opposite to the ink cavities 2 (FIG. 1) by means of the technique described in the embodiment shown in FIG. 3. Ink reservoirs 51 are formed in the direction in which the nozzle openings 7 are formed such that the nozzle openings 7 are interposed between the ink reservoirs 51.

The ink reservoirs 51 are formed through the following steps. Specifically, a silicon dioxide protecting layer, which has been described in FIG. 5(*c*), is formed in the areas where the ink reservoirs 51 are to be formed. The silicon dioxide protecting layer is subjected to the multiple exposure which has been described in FIG. 5(*d*), so that the silicon dioxide layers 41 and 41' are thinly formed.

After the silicon monocrystalline substrate 50 has been anisotropically etched to form the nozzle openings 7, namely, after a step equivalent to the step shown in FIG. 5(*e*) in which etching is carried out to make the ink cavities 2 has been completed, the silicon dioxide layer made thinner as a result of the multiple exposure as in the step shown in FIG. 5(*f*) is selectively removed from the areas where the ink reservoirs 51 are to be formed.

Like the step shown in FIG. 5(*g*), the silicon monocrystalline substrate 50 is anisotropically etched in the 40% potassium hydroxide solution, whereby recesses are formed to a depth of about 100 $\mu$m in the areas where the ink reservoirs 51 are to be formed.

Compared to the nozzle plate comprising the ink reservoir 3 formed only in the spacer 1, the nozzle plate having the above described construction makes it possible to increase the depth of the ink reservoirs of the recording head overall. Even if the width of the ink reservoirs is reduced, a volume which permits the ink reservoirs to operate can be ensured. Consequently, the width of the recording head is reduced, which results in a more compact recording head.

Even if the silicon monocrystalline substrate 50 having a sufficient thickness is used to form a nozzle plate which is easier to handle, an increased number of nozzle plates comprising the previously described spacers are formed from a silicon monocrystalline wafer having an identical size, which in turn makes it possible to reduce the manufacturing cost.

Figure 7A:
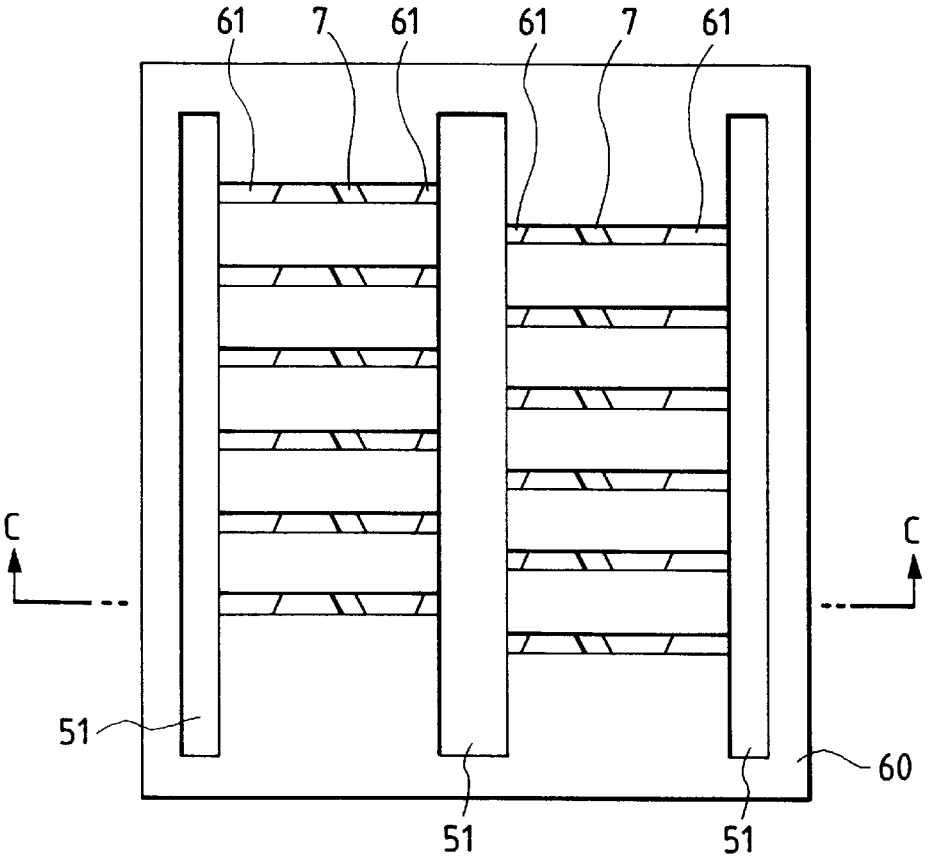
FIG. 7(*a*) is a plan view of a nozzle plate according to a third embodiment of the present invention, and FIG. 7(*b*) is a cross-sectional view taken along line B—B shown in FIG. 7(*a*)
Figure 7B:
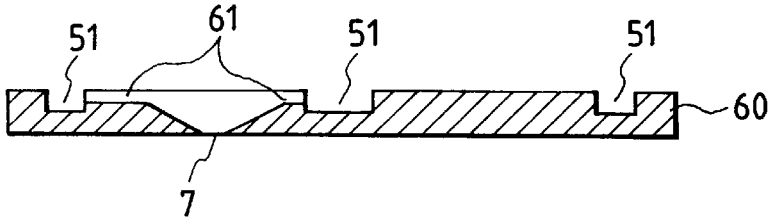

FIG. 7 shows a third embodiment of the present invention. In the present embodiment, the ink supply ports are formed in the nozzle plate in addition to the ink reservoirs.

In the drawing, reference numeral 60 designates a silicon monocrystalline substrate having a face (110) on its surface. The nozzle openings 7 are formed in the silicon monocrystalline substrate so as to be opposite to the ink cavities formed in the spacer 1 by means of the same technique as is described in the embodiment shown in FIGS. 3(*a*) to 3(*j*). In the present embodiment, the ink reservoirs 51 are formed in the direction in which the nozzle openings 7 are formed in such a way that the nozzle openings are interposed between the ink reservoirs 51. Ink supply ports 61 are formed on both longitudinal sides of the wider opening of each discharge orifice 7 so as to communicate with the same.

The ink reservoirs 51 and the ink supply ports 61 are formed through the following steps. Specifically, a silicon dioxide protecting layer, which has been described in the step shown in FIG. 5(*c*), is formed in the areas where the ink reservoirs 51 are to be formed. The silicon dioxide protecting layer is subjected to the multiple exposure which has been described in the step shown in FIG. 5(*d*), so that it becomes thin.

After the silicon monocrystalline substrate 60 has been anisotropically etched to form the nozzle openings 7, namely, after a step equivalent to the step shown in FIGS. 5(*e*) in which etching is carried out to make the ink cavities 2 has been completed, the silicon dioxide layer that has been made thinner as a result of the multiple exposure as in the step shown in FIG. 5(*f*) is selectively removed from the areas where the ink reservoirs 51 and the ink supply ports 61 are to be formed.

Like the step shown in FIG. 5(*g*), the silicon monocrystalline substrate 60 is anisotropically etched in the 40% potassium hydroxide solution, whereby recesses can be formed to a depth of about 100 $\mu$m and a depth of about 150 $\mu$m in the areas where the ink supply ports 61 and the ink reservoirs 51 are to be formed.

Figure 8:
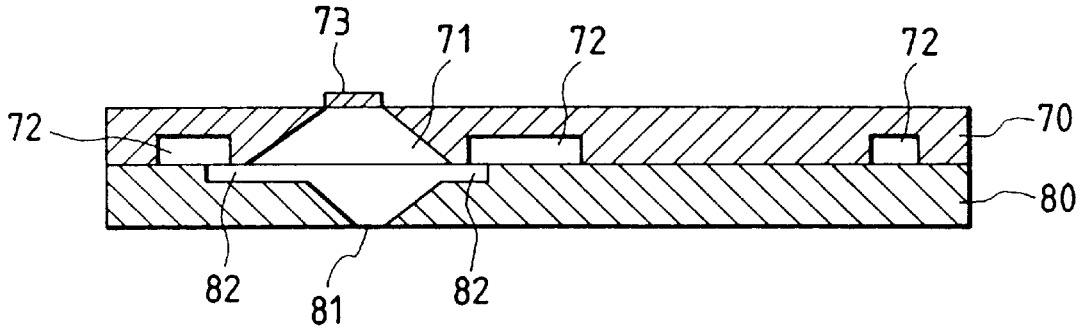
FIG. 8 is a cross-sectional view of an ink-jet recording head according to a fourth embodiment of the present invention.
Figure 9:
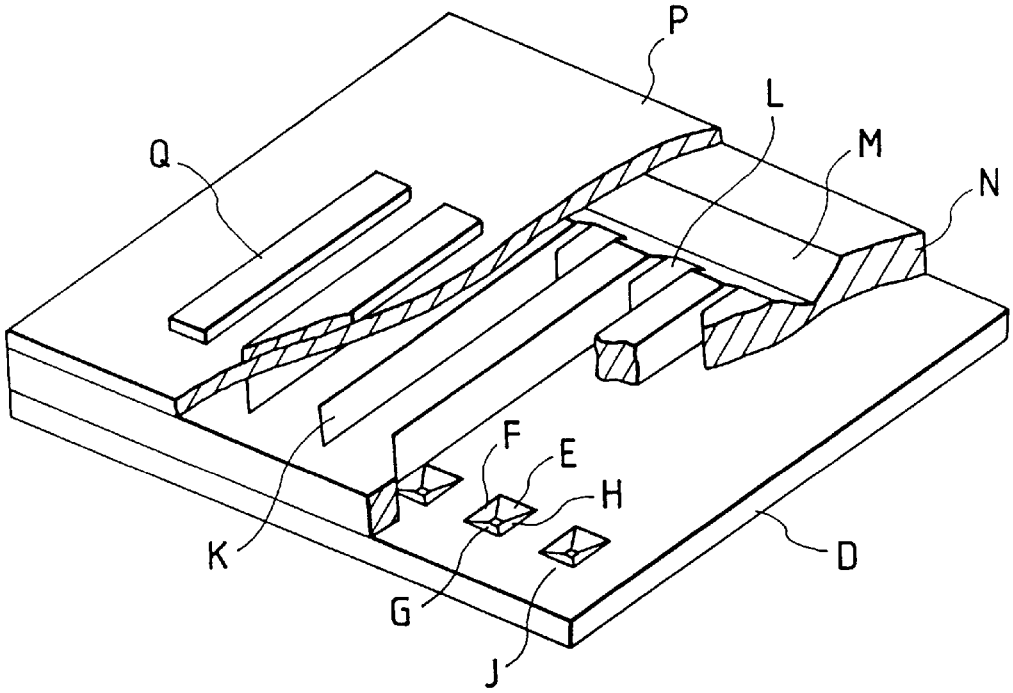
FIG. 9 PRIOR ART
FIG. 9 is a perspective view of one example of a conventional nozzle plate which uses a silicon monocrystalline substrate.

FIG. 8 shows a fourth embodiment of the present invention. In the present embodiment, ink cavities 71 and ink reservoirs 72 are formed in a first silicon monocrystalline substrate 70, whereas nozzle openings 81 and ink supply ports 82 are formed in a second silicon monocrystalline substrate 80. The ink-jet recording head is made using a combination of these two silicon monocrystalline substrates.

It only necessary for the first silicon monocrystalline substrate 70 to undergo the manufacturing steps shown in FIGS. 5(*a*) to 5(*g*) without preparation of the pattern 49 to make the ink supply ports and formation of the thin silicon oxide film 41'.

It is only necessary for the second silicon monocrystalline substrate 80 to be patterned so as to form the nozzle openings 81 and the ink supply ports 61 and to be anisotropically etched, without forming the ink reservoirs 51 made in the previously described silicon monocrystalline substrate 60 of the nozzle plate shown in FIG. 7(*a*) and 7(*b*).

As a result of the formation of the ink reservoirs 51, which are identical with those shown in FIGS. 7(*a*) and 7(*b*), in the silicon monocrystalline substrate 80, a recording head can be formed which ensures the volume of the ink reservoirs by increasing their depth.

In the above described embodiment, the means of pressurizing the ink cavities is made up of the element which displaces the cover member. It is also evident that the nozzle plate of the present invention is applicable as a nozzle plate for use in another type of recording head which displaces a vibrating plate by means of an electrostatic force or recording head which comprises heat generating elements housed in ink cavities.

As described above, according to the present invention, the nozzle plate has a plurality of nozzles for discharging ink which is fed from an ink reservoir to ink cavities through ink supply ports and is pressurized by pressurizing means, and the nozzle plate is characterized by forming nozzle openings in a silicon monocrystalline substrate with a lattice face (110) by anisotropic etching in such a way that through holes have faces (1-11) and (-11-1) in the direction in which the nozzle openings are arrayed as well as faces (111) and (11-1) in the direction of the axis of the ink cavity. The nozzle openings can be formed so as to have the faces (1-11) and (-11-1) normal to the silicon monocrystalline substrate in the direction in which the nozzle openings are arrayed. Accordingly, the width of the discharge orifice becomes constant irrespective of the time required to etch the substrate. In this way, nozzle openings can be formed in a silicon monocrystalline substrate having a thickness suitable for a nozzle plate by anisotropic etching.

What is claimed is:

1. A method of manufacturing an ink-jet head comprising the steps of:

forming an etch resist film on first and second sides of a silicon monocrystalline substrate having a face (110);

etching part of the etch resist film on said first side of said substrate to expose a first area of the silicon monocrystalline substrate so as to form cylindrical portions having sufficient diameter to discharge ink droplets;

etching a second exposed area on the second side of said substrate anisotropically to form a nozzle plate having a plurality of nozzle openings so as to have faces (1-11) and (-11-1) in the direction in which the nozzle openings are arrayed, wherein said nozzle openings are formed after the cylindrical portions are formed; and laminating a spacer having a plurality of ink reservoirs, ink supply ports and ink cavities on the side of the second exposed area.

2. The method of manufacturing an ink-jet head according to claim 1, further comprising the step of forming other recesses in the area where the ink reservoir is positioned, on the side of the second exposed area.

3. The method of manufacturing the nozzle plate as defined in claim 1, further comprising the step of forming other recesses in the areas where the ink supply ports are positioned, on the side of the second exposed area.

4. The method of manufacturing the nozzle plate as defined in claim 1, further comprising the step of forming other recesses in the areas where the ink reservoirs and the ink supply ports are positioned, on the side of the second exposed area.

5. The method of manufacturing the nozzle plate as defined in claim 1, further comprising the steps of: removing all of said etch resist film; and thermally oxidizing the first and second exposed area of said nozzle plate.

6. A method of manufacturing an ink-jet head comprising the steps of:

forming an etch resist film on first and second sides of a silicon monocrystalline substrate having a face (110);

etching part of the etch resist film on said first side of the silicon monocrystalline substrate to expose a first area of the silicon monocrystalline substrate so as to form cylindrical portions having sufficient diameter to discharge ink droplets;

etching the exposed first area isotropically to form recesses;

forming an etch resist film on the recesses;

etching part of the etch resist film on said second side of the silicon monocrystalline substrate so as to expose a second area of the silicon monocrystalline substrate to form a pattern suitable for anisotropically etching the recesses;

etching the exposed second area of the second side anisotropically to form a nozzle plate having a plurality of nozzle openings so as to have faces (1-11) and (-11-1) in the direction in which the nozzle openings are arrayed, wherein said nozzle openings are formed after the cylindrical portions are formed; and laminating a spacer having a plurality of ink reservoirs, ink supply ports and ink cavities on the second side.

7. The method of manufacturing an ink-jet head according to claim 6, further comprising the step of forming other recesses in the area where the ink reservoir is positioned, on the second side of the monocrystalline substrate.

8. The method of manufacturing the nozzle plate as defined in claim 6, further comprising the step of forming other recesses in the areas where the ink supply ports are to be positioned, on the second side of the monocrystalline substrate.

9. The method of manufacturing the nozzle plate as defined in claim 6, further comprising the step of forming other recesses in the areas where the ink reservoirs and the ink supply ports are positioned, on the second side of the monocrystalline substrate.

10. The method of manufacturing the nozzle plate as defined in claim 6, further comprising the steps of: removing the all etch resist film; and thermally oxidizing the overall surface of the resultant.

11. The method as claimed in claim 1, wherein said nozzle openings have maximum diameter portions which are open to ink cavities and minimum diameter portions which are positioned opposite to said maximum diameter portions.

12. The method as claimed in claim 6, wherein said nozzle openings have maximum diameter portions which are open to ink cavities and minimum diameter portions which are positioned opposite to said maximum diameter portions.

13. A method of manufacturing an ink-jet head comprising the steps of:

forming an etch resist film on first and second sides of a silicon monocrystalline substrate having a face (110);

etching part of the etch resist film on said first side of said substrate to expose a first area of the silicon monocrystalline substrate so as to form cylindrical portions having sufficient diameter to discharge ink droplets;

etching an exposed second area on the second side of said substrate anisotropically to form a plurality of nozzle openings so as to have faces (1-11) and (-11-1) in the direction in which the nozzle openings are arrayed, wherein said nozzle openings are formed after the cylindrical portions are formed;

laminating a spacer having a plurality of ink reservoirs, ink supply ports and ink cavities on the side of the second exposed area; and forming other recesses in the area where the ink reservoir is positioned, on the side of the second exposed area.

14. A method of manufacturing an ink-jet head comprising the steps of:

forming an etch resist film on first and second sides of a silicon monocrystalline substrate having a face (110);

etching part of the etch resist film on said first side of said substrate to expose a first area of the silicon monocrystalline substrate so as to form cylindrical portions having sufficient diameter to discharge ink droplets;

etching an exposed second area on the second side of said substrate anisotropically to form a plurality of nozzle openings so as to have faces (1-11) and (-11-1) in the direction in which the nozzle openings are arrayed, wherein said nozzle openings are formed after the cylindrical portions are formed;

laminating a spacer having a plurality of ink reservoirs, ink supply ports and ink cavities on the side of the second exposed area; and forming other recesses in the area where the ink supply ports are positioned, on the side of the second exposed area.

15. A method of manufacturing an ink-jet head comprising the steps of:

forming an etch resist film on first and second sides of a silicon monocrystalline substrate having a face (110);

etching part of the etch resist film on said first side of said substrate to expose a first area of the silicon monocrystalline substrate so as to form cylindrical portions having sufficient diameter to discharge ink droplets;

etching an exposed second area on the second side of said substrate anisotropically to form a plurality of nozzle openings so as to have faces (1-11) and (-11-1) in the direction in which the nozzle openings are arrayed, wherein said nozzle openings are formed after the cylindrical portions are formed, laminating a spacer having a plurality of ink reservoirs, ink supply ports and ink cavities on the side of the second exposed area; and forming other recesses in the area where the ink reservoirs and the ink supply ports are positioned, on the side of the second exposed area.

16. A method of manufacturing an ink-jet head comprising the steps of:

forming an etch resist film on first and second sides of a silicon monocrystalline substrate having a face (110);

etching part of the etch resist film on said first side of said substrate to expose a first area of the silicon monocrystalline substrate so as to form cylindrical portions having sufficient diameter to discharge ink droplets;

etching an exposed second area on the second side of said substrate anisotropically to form a plurality of nozzle openings so as to have faces (1-11) and (-11-1) in the direction in which the nozzle openings are arrayed, wherein said nozzle openings are formed after the cylindrical portions are formed;

laminating a spacer having a plurality of ink reservoirs, ink supply ports and ink cavities on the side of the second exposed area;

removing all of said etch resist film; and thermally oxidizing the exposed first and second areas of the nozzle plate.

* * * * *